United States Patent [19]

Becker et al.

[11] Patent Number: 4,487,590

[45] Date of Patent: Dec. 11, 1984

[54] CHILDREN'S BOOKS

[76] Inventors: James F. Becker, 3008 3rd St., Apt. A; Andrew S. Mayer, 706½ Ashland Ave., both of Santa Monica, Calif. 90405

[21] Appl. No.: 455,029

[22] Filed: Jan. 3, 1983

[51] Int. Cl.[3] ..... A63H 33/00

[52] U.S. Cl. ..... 446/147; 281/15 R; 283/63 R

[58] Field of Search ..... 283/63 R; 46/1 B, 35, 46/34, 36, 37; 281/15 R, 15 A; 229/52 B; 206/485, 579, 232; 150/52 B; 383/7, 10; 190/115, 118

[56] References Cited

U.S. PATENT DOCUMENTS

| | | | |
|---|---|---|---|
| 1,571,475 | 2/1926 | Guenther . | |
| 2,422,235 | 6/1947 | Greene | 150/52 B |
| 2,489,240 | 11/1949 | Meyer | 46/34 |
| 2,769,474 | 11/1956 | Klotz | 190/115 |
| 2,874,707 | 2/1959 | Koppel | 283/63 R |
| 3,195,925 | 7/1965 | Walker, Jr. | 281/33 |
| 3,462,069 | 8/1969 | Suominen | 383/10 |
| 3,918,180 | 11/1975 | Chamberlin | 434/173 |

OTHER PUBLICATIONS

"Funny Fingers", by Kent Salisbury, published by Western Publishing Co., Inc., 1971.

*Primary Examiner*—Mickey Yu

*Attorney, Agent, or Firm*—Knobbe, Martens, Olson & Bear

[57] ABSTRACT

A children's book includes printed matter which cooperates with structural features of the book. The printed matter depicts, e.g. a scene from the driver's seat of a vehicle, including, e.g., as a steering wheel and instrument panel. Openings are formed, adjacent to the edge of the steering wheel, within the area bounded by such wheel, so that a child can place his fingers through those openings and, in effect, grasp the steering wheel. The child, therefore, can imagine himself as guiding the vehicle with the steering wheel as he reads the book.

7 Claims, 4 Drawing Figures

Fig. 1
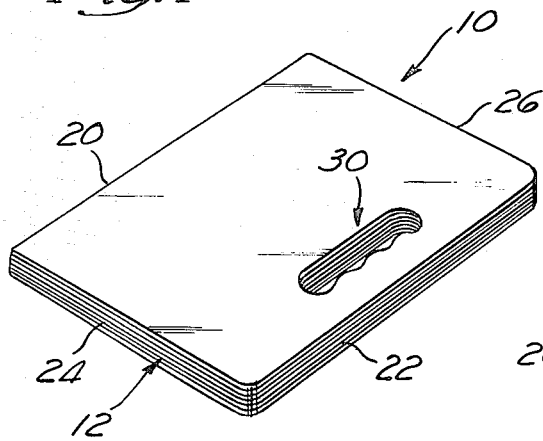
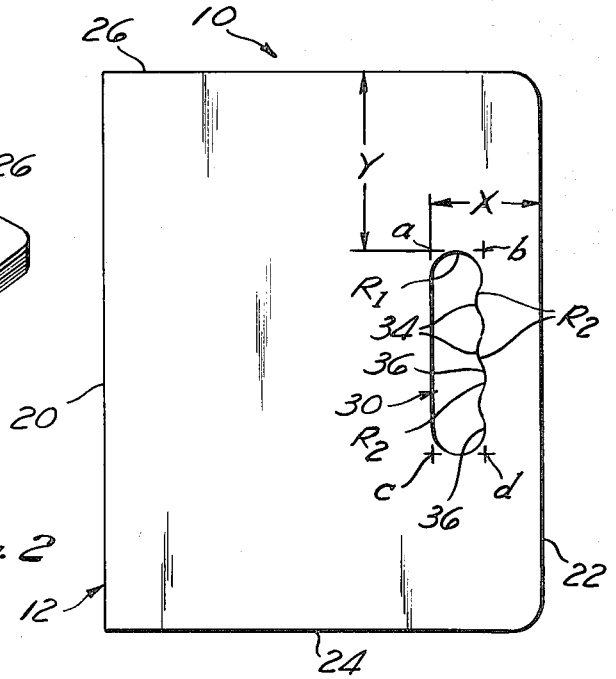
Fig. 2
Fig. 3
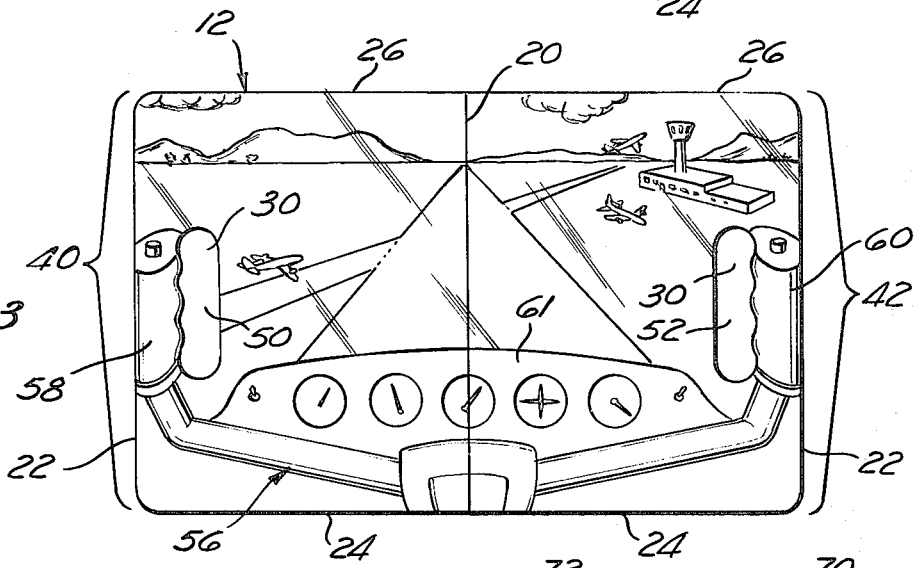
Fig. 4
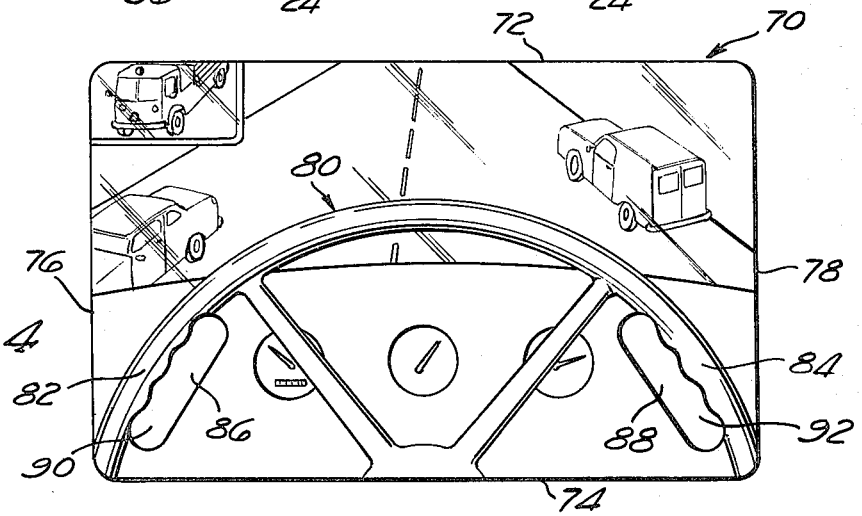

CHILDREN'S BOOKS

BACKGROUND OF THE INVENTION

The present invention relates to children's books, and particularly to children's books having entertainment features.

It is sometimes difficult to interest young children in reading books. The prior art has addressed this problem by incorporating entertainment features into children's books to enhance reader enjoyment. Such entertainment features may, for example, comprise pop-up figures, puppets, or other items which may be attached to the books. These figures or puppets, however, are sometimes damaged or separated from the book during normal use, which may cause the child to lose interest in the book. Therefore, there is a need in the art for a book having entertainment features which retain the child's interest, while being rugged and durable.

SUMMARY OF THE INVENTION

In the present invention, the printed matter on the pages of the book cooperates with the structural features of the book to enhance the reader's enjoyment and maintain his interest. Specifically, the printed matter, in the preferred embodiment, depicts a scene from the driver's seat of a vehicle, including, for example, the vehicle steering wheel and dashboard or instrument panel. The steering wheel is positioned so that its periphery is close to the side marginal edges of the book. Openings are formed, adjacent to the edge of the steering wheel, within the area bounded by the steering wheel, so that the child can place his hands through these openings and, in effect, grasp the steering wheel. The child can thus imagine himself as being in the driver's seat of the vehicle, guiding the vehicle with the steering wheel, as he reads the book. As he turns to a new page in the book, a different vehicle may be shown or, alternatively, a sequence of events involving that same vehicle may be shown. Thus, the reader is actually the central character in the book, as he imagines himself, e.g., driving a fire truck to the scene of a fire, or landing an airplane at a busy airport.

Since the structural features of the book are formed from the pages themselves, there is little chance that the book will be damaged. Further, there are no protrusions or objects which could be separated from the book, thus enhancing the book's safety.

DESCRIPTION OF THE DRAWINGS

These and other advantages of the present invention may be more fully understood through reference to the drawings, in which:

FIG. 1 is a perspective view of the children's book of the present invention, showing overlapping apertures formed in the pages thereof;

FIG. 2 is an elevation view of one of the pages of the book of FIG. 1, showing one exemplary configuration for the apertures;

FIG. 3 is a schematic elevation view of the book of FIG. 1, showing the book open, with a portion of the pages on the left, and another portion of the pages on the right, depicting printed matter comprising a vehicle steering wheel, and illustrating the cooperation of the apertures with the steering wheel, which permits the reader to "grasp" the steering wheel and thus, give the reader the impression of being in the driver's seat of the vehicle; and FIG. 4 is an alternative embodiment of the present invention, showing a single sheet having apertures which cooperate with printed matter depicting a steering wheel to permit the reader to "grasp" the steering wheel and thus, give the reader the impression of being in the driver's seat of the vehicle.

DETAILED DESCRIPTION OF THE PREFERRED EMBODIMENT

As shown in FIG. 1, the children's book 10 of the present invention comprises plural, generally rectangular pages 12, each having four marginal edges 20, 22, 24, and 26, with the edges 20 and 22 forming the sides of the book 10, and the edges 24 and 26 forming the bottom and top, respectively, of the book 10. The pages 12 of the book 10 may be bound, e.g., along the marginal edges 20. In the embodiment shown, the pages 12 of the book 10 are structurally identical. By way of specific example, the dimensions of the pages 12 may be six inches by $7\frac{3}{4}$ inches, and the pages 12 may be formed from 1/16 inch cardboard.

An exemplary one of the pages 12 is shown in FIG. 2. As illustrated therein, each page 12 includes an opening or aperture 30, formed in an area bounded by a rectangle (shown in dotted lines), having four corners labeled a, b, c and d, respectively. The location of these corners a, b, c, d for the specific embodiment shown, may be described in terms of dimensions x and y, where x is the distance between the side marginal edge 22 and any one of the corners a, b, c, d, and y is the distance between the top marginal edge 26 and any one of the corners a, b, c, d. Although only the corner "a" is labeled in FIG. 2 as having dimensions x and y, it will be understood that each of the other corners b, c and d have corresponding x and y dimensions. By way of specific example, these x and y dimensions for each of the corners a, b, c, d may be as follows:

| Corner | X | Y |
|---|---|---|
| a | $1\frac{1}{2}$ inches | $2\frac{5}{8}$ inches |
| b | $\frac{3}{4}$ inch | $2\frac{5}{8}$ inches |
| c | $1\frac{1}{2}$ inches | $5\frac{1}{8}$ inches |
| d | $\frac{3}{4}$ inch | $5\frac{1}{8}$ inches |

As shown in FIG. 2, the contour of the aperture 30 generally follows the perimeter of the rectangle; however, at each of the corners a, b, c, d, the aperture 30 is rounded, following a contour having a radius of curvature $R_1$. Moreover, between the corners b and d, the contour of the aperture 30 is scalloped, so as to form a series of peaks 34 and valleys 36, each having a radius of curvature $R_2$. Preferably, there are three peaks 34 and four valleys 36, so that, when a child inserts his fingers into the aperture 30, each of his four fingers will rest in a respective one of the valleys 36, with a peak 34 being between each pair of adjacent fingers. By way of specific example, the radii of curvature $R_1$ and $R_2$ may be $\frac{3}{8}$ inch and 7/16 inch, respectively. The aperture 30 may be formed e.g. by die cutting.

In the embodiment shown, the pages 12 are structurally identical so that, when they are bound to form the book 10, the apertures 30 of each page 12 will overlap when the book 10 is closed, with their respective edges congruent, thus forming a convenient handle for carrying the book 10. However, when the book 10 is open, so that a portion 40 of the pages 12 are to the left of the binding 20, and the remaining portion 42 of the pages 12 are to the right of the binding 20, the apertures 30 form a left handhold area 50, and a right handhold area 52, as shown in FIG. 3. Printed matter, depicting, e.g., a steering wheel 56, is provided on the pages 12 that are visible to the reader, with a gripping portion 58 of the wheel 56 positioned in proximal relationship to the marginal edges 22 of the pages 40 on the left side of the book, and another gripping portion 60 of the wheel 56 positioned in proximal relationship to the marginal edges 22 of the pages 42 on the right side of the book. The portion 58 is disposed adjacent to the handhold 50, and between the handhold 50 and marginal edges 22 of the pages 40 on the left side of the book. Similarly, the portion 60 is disposed adjacent to the handhold 52, and between the handhold 52 and the marginal edges 22 of the pages 42 on the right side of the book. Thus, the handholds 50, 52 are both within the area bounded by the steering wheel 56. As shown in FIG. 3, the inside edges of the steering wheel portions 58, 60 may be contiguous with the scalloped edges of the apertures forming handhold areas 50, 52, respectively, so that when a child places his fingers through one of the handholds 50, 52 (from the rear of the pages as viewed in FIG. 3, with his thumb on the top page), the child will, in effect, "grip" the steering wheel 56. This gives the child the impression of being in the driver's seat of the vehicle, and thus, enhances his interest in, and enjoyment of, the book.

Although any type of vehicle steering mechanism may be depicted, the embodiment of FIG. 3 illustrates an aircraft steering wheel. Accordingly, the printed matter also includes a visual representation of an instrument panel 61 of an aircraft cockpit. In addition, a representation of the outside environment, e.g. an airport runway, may be included above the instrument panel 61 to enhance the reader's perception of e.g. flying an airplane. Different environmental scenes may be depicted on sequential pages, so that as the reader pages through the book 10, a series of events, e.g. representing steps in a take-off or landing, are depicted. These environmental scenes will be referred to herein as "environmental printed matter." Textual material may be included to describe each of these events.

It will be understood that, in addition to aircraft cockpits and runways, other types of vehicle interiors and environmental matter may be depicted, e.g. that of a car or fire engine. Moreover, instead of depicting the vehicle interior and environmental matter on the adjacent pages of an open book, as in FIG. 3, they may be depicted on a single sheet having, e.g., a top marginal edge 72, a bottom marginal edge 74, and side marginal edges 76, 78, as shown in FIG. 4. The vehicle steering wheel 80 depicted in FIG. 4 is that of a fire engine. Gripping portions 82, 84 of the wheel 80 are disposed in proximal relationship to the marginal edges 76, 78, respectively, so that the portions 82, 84 are between these edges 76, 78 and handhold areas 86, 88, respectively, formed by apertures 90, 92, respectively. Like the handholds 50, 52, discussed in reference to FIG. 3, the handholds 86, 88 are disposed adjacent to the steering wheel portions 82, 84, within the area bounded by the wheel 80. Further, the apertures 90, 92, forming the handholds 86, 88, may have scalloped edges which are contiguous with corresponding scalloped edges on the interior edge of the wheel 80. Thus, the embodiment of FIG. 4 is substantially the same as that of FIG. 3, the principal difference being that the printed matter is on a single sheet 70 rather than on adjacent pages of a book. If desired, such single sheets may be bound along one side, e.g. by a plastic or wire spiral binding (not shown).

While the present invention has been described in terms of printed matter which depicts a steering wheel, it will be understood that other types of steering mechanisms may be depicted. For example, on a submarine the steering mechanism may comprise a pair of levers (not shown) which project from a dashboard or instrument panel. In such case, these levers would be placed, e.g., in a position relative to their handholds (not shown) which corresponds to the position of the steering wheel grip portions 58, 60 (FIG. 3) relative to the handholds 50, and 52 (FIG. 3).

What is claimed is:

1. A book for children, comprising:

plural sheets, bound at a binding to form said book, adjacent pages of said book having printed matter depicting the operating compartment of a vehicle and a steering wheel in said operating compartment of said vehicle, said steering wheel sized for gripping by a child's hand, said sheets having respective openings therein, each of said openings sized to receive the fingers of a child's hand, at least one of said openings positioned adjacent to said steering wheel depicted by said printed matter to allow gripping of said wheel by the child's hand, with a portion of said printed matter depicting said steering wheel between said one of said openings and a marginal edge of said book, to permit the child to pretend he is driving said vehicle, said marginal edge opposite the binding of said book.

2. A book for children, comprising:

plural sheets, bound to form said book, adjacent pages of said book having printed matter depicting the operating compartment of a vehicle and a steering wheel in said operating compartment of said vehicle, said steering wheel sized for gripping by a child's hand, and bounding an area of said book, said sheets having respective openings therein, each of said openings sized to receive the fingers of a child's hand, and at least one of said openings disposed within the area bounded by said steering wheel and positioned adjacent to said steering wheel depicted by said printed matter to allow gripping of said wheel by the child's hand, with said steering wheel between said at least one of said openings and an edge of said book, to permit the child to pretend he is driving said vehicle.

3. A book for children, comprising:

plural sheets, bound to form said book, adjacent pages of said book having printed matter depicting the operating compartment of a vehicle and a steering wheel in said operating compartment of said vehicle, said steering wheel sized for gripping by a child's hand, said sheets having respective openings therein, each of said openings sized to receive the fingers of a child's hand, and an edge of at least one of said openings positioned adjacent to and contiguous with an interior edge of said steering wheel depicted by said printed matter to allow gripping of said wheel by the child's hand, with said steering wheel between said opening and an edge of said book to permit the child to pretend he is driving said vehicle.

4. A book for children, as defined by claim 3, wherein said edge of said at least one of said openings, and said edge of said steering wheel are scalloped.

5. An apparatus, for use by children, comprising:

a sheet, bounded by marginal edges, having printed matter depicting a vehicle steering mechanism, said printed matter including a gripping portion proximal to one marginal edge of said sheet, said sheet including an opening therethrough which is sized and positioned to provide a handhold for receiving a child's hand to allow gripping of said steering mechanism, said gripping portion disposed between said handhold and said one marginal edge, and an edge of said handhold contiguous with an edge of said gripping portion of said printed matter depicting a steering mechanism.

6. An apparatus, as defined by claim 5, wherein said edge of said handhold has scalloped edges, and said scalloped edges are contiguous with corresponding scalloped edges on said gripping portion of said printed matter depicting said steering mechanism.

7. An apparatus, as defined by claim 5, additionally comprising:

a second opening, proximal to another of said marginal edges of said sheet for forming a second handhold in said sheet, a second gripping portion of said printed matter depicting said steering mechanism positioned between an edge of said second handhold and said another of said marginal edges.

* * * * *